US007066401B2

(12) United States Patent
Huffman et al.

(10) Patent No.: US 7,066,401 B2
(45) Date of Patent: Jun. 27, 2006

(54) LANCE-TYPE LIQUID REDUCING AGENT SPRAY DEVICE

(75) Inventors: David C. Huffman, Merrimack, NH (US); Michel Thenin, Nashua, NH (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/529,932

(22) PCT Filed: Oct. 2, 2003

(86) PCT No.: PCT/US03/31181

§ 371 (c)(1),
(2), (4) Date: Oct. 3, 2005

(87) PCT Pub. No.: WO2004/030827

PCT Pub. Date: Apr. 15, 2004

(65) Prior Publication Data

US 2006/0108443 A1 May 25, 2006

Related U.S. Application Data

(60) Provisional application No. 60/415,421, filed on Oct. 2, 2002.

(51) Int. Cl.
*B05B 1/24* (2006.01)

(52) U.S. Cl. ..... 239/132; 239/132.3; 239/132.5; 239/128; 239/132.1; 431/160

(58) Field of Classification Search ..... 239/128, 239/132, 132.3, 132.5, 132.1, 124; 422/198, 422/200, 201, 202; 264/328.15; 431/160; 425/549; 266/48

See application file for complete search history.

(56) References Cited

U.S. PATENT DOCUMENTS 1,849,814 A * 3/1932 Woodruff ..... 239/132.5
3,902,850 A * 9/1975 Lehnert ..... 422/133
5,503,548 A * 4/1996 Franke et al. ..... 431/10
5,954,267 A * 9/1999 Yamasaki et al. ..... 239/13

* cited by examiner

*Primary Examiner*—Dinh Q. Nguyen
(74) *Attorney, Agent, or Firm*—Leydig, Voit & Mayer, Ltd.

(57) ABSTRACT

A lance-type spraying assembly for directing a reducing agent into a combustion zone or discharging combustion gases for Nox emission control. The spraying assembly including a lance body having an inlet end and a downstream end and a spray nozzle arranged at the downstream end of the lance body. The lance body includes an air passage for connection to an air supply, a liquid reducing agent supply passage for connection to a liquid reducing agent supply and a liquid reducing agent return passage. The liquid reducing agent supply passage communicates with the spray nozzle. The liquid reducing agent return passage communicates with the liquid reducing agent supply passage near the downstream end of the lance body for recirculating a portion of the liquid reducing agent and extends near the liquid reducing agent supply passage along at least a portion of the length thereof in order to help cool the liquid reducing agent therein. The liquid reducing agent return passage is sealed against the spray nozzle. The air passage extends near at least a portion of the liquid reducing agent supply passage in order to help cool the liquid reducing agent therein.

10 Claims, 6 Drawing Sheets

10
11
12
14
15
16
18
19
20
21
25
26
28
29
32
34
35
36
40
41
42
45
46
47
48
49
55

LANCE-TYPE LIQUID REDUCING AGENT SPRAY DEVICE

FIELD OF THE INVENTION

The present invention relates generally to devices for controlling NOx emissions in combustion processes, and more particularly to a spray device or system for directing a reducing agent, such as urea, into a combustion zone or discharging combustion gases for NOx emission control.

BACKGROUND OF THE INVENTION

NOx emissions are a product of combustion processes and contribute to major pollution problems such as acid rain. Two processes for de-nitrification are SNCR (Selective Non-Catalytic Reduction) and SCR (Selective Catalytic Reduction). Both processes commonly use ammonia as a reducing agent in the de-nitrification process of converting NOx into nitrogen and water vapor.

With the SNCR (Selective Non-Catalytic Reduction) process, ammonia is injected directly into combustion flame at temperatures that range from about 878 to 1158 degrees C. (1600 to 2100 degrees F.). The ammonia directly reacts with the NOx, reducing the emissions by 30–70%.

With the SCR (Selective Catalytic Reduction) process, ammonia vapor is injected into the flue gas stream at temperatures from 318 to 430 degrees C. (600 to 800 degrees F.). The gas then passes over a catalyst where the reaction occurs reducing the emissions by 80 to 90%. In this process, atomization and control of droplet size are critical to the reaction process because of the reduced reaction temperature necessitated by the operating temperature of the catalyst.

In both reduction methods an injection system for the ammonia is used. Because of the higher operating temperatures with the SNCR process, hydraulic nozzles can be used without the necessity for pressurized air atomization of the liquid reducing agent. In such SNCR processes, hydraulic nozzles are mounted on lances that extend into the combustion flame. In the SCR process, air-atomizing nozzles are mounted on lances that extend into the discharging gas stream. Because of the lower temperatures at such location, the injection device must supply small droplets that vaporize quickly.

Safety concerns with anhydrous and aqueous ammonia has increased interest in using urea as a safe and economical alternative. The major problem with urea is that it is temperature sensitive. The temperature of the urea must be maintained below 70° C. (158° F.) prior to atomization and direction to avoid crystallization. If the urea crystallizes due to prior exposure to high temperatures it will clog the injection piping and discharge orifices. Atomization and control of droplet size also are critical to the reaction process because any crystallization of the urea prior to atomization and discharge is detrimental to reaction process.

OBJECTS AND SUMMARY OF THE INVENTION

It is an object of the present invention to provide a spraying system for direction of temperature sensitive reducing agents, such as urea, for NOx emission control in combustion processes which prevents crystallization of the urea that might impede the flow and atomization of the reducing agent. More particularly, the invention relates to a specially designed lance-type spray device which recirculates the reducing agent, i.e. urea, to keep it below its crystallization temperature prior to atomization and discharge. Urea that is not atomized and discharged is returned to a supply vessel, where it is cooled and then fed to the directing lance in a recirculating loop. The urea itself is used as a cooling medium. The lance can be fitted with hydraulic or air atomizing nozzles depending on the process, SNCR or SCR. The lance also can be fitted with additional cooling means depending on the application, such as a liquid cooling jacket, a cooling air discharge tube, a vacuum insulator jacket, or an insulation jacket.

The invention further can be used in other elevated temperature applications, such as gas cooling and conditioning. Nor is the invention limited to urea atomizing/injection applications.

Other objects and advantages of the invention will become apparent upon reading the following detailed description and upon reference to the drawings, in which:

Figures 1, 2, 3, 4:
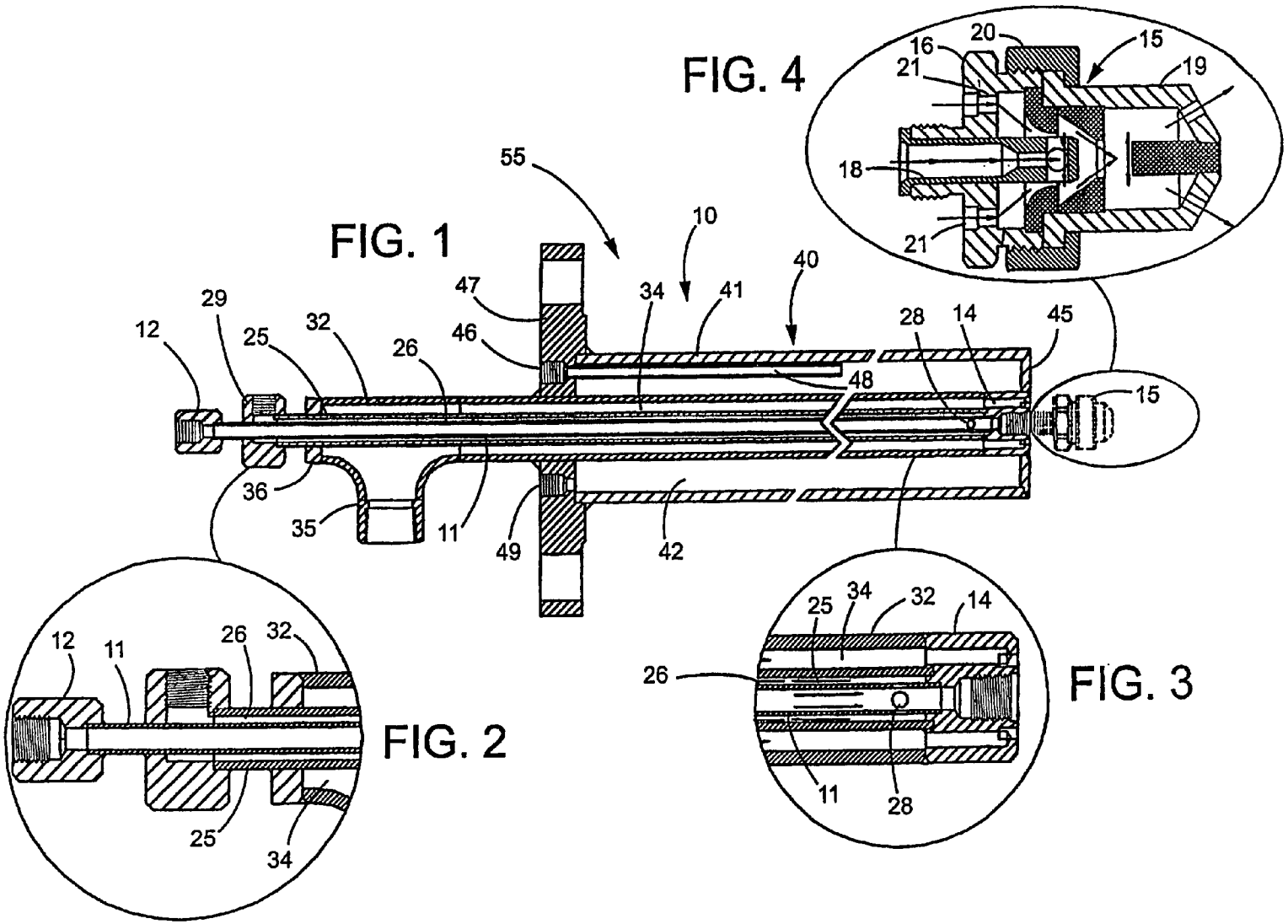
FIG. 1 is a longitudinal section of an illustrative lance-type urea-spraying device in accordance with the invention with the spray nozzle assembly shown in phantom, removed from the device.
FIGS. 2 and 3 are enlarged fragmentary sections of the lance shown in FIG. 1.
FIG. 4 is an enlarged longitudinal section of the illustrated spray nozzle assembly.
Figures 5, 6, 7, 8:
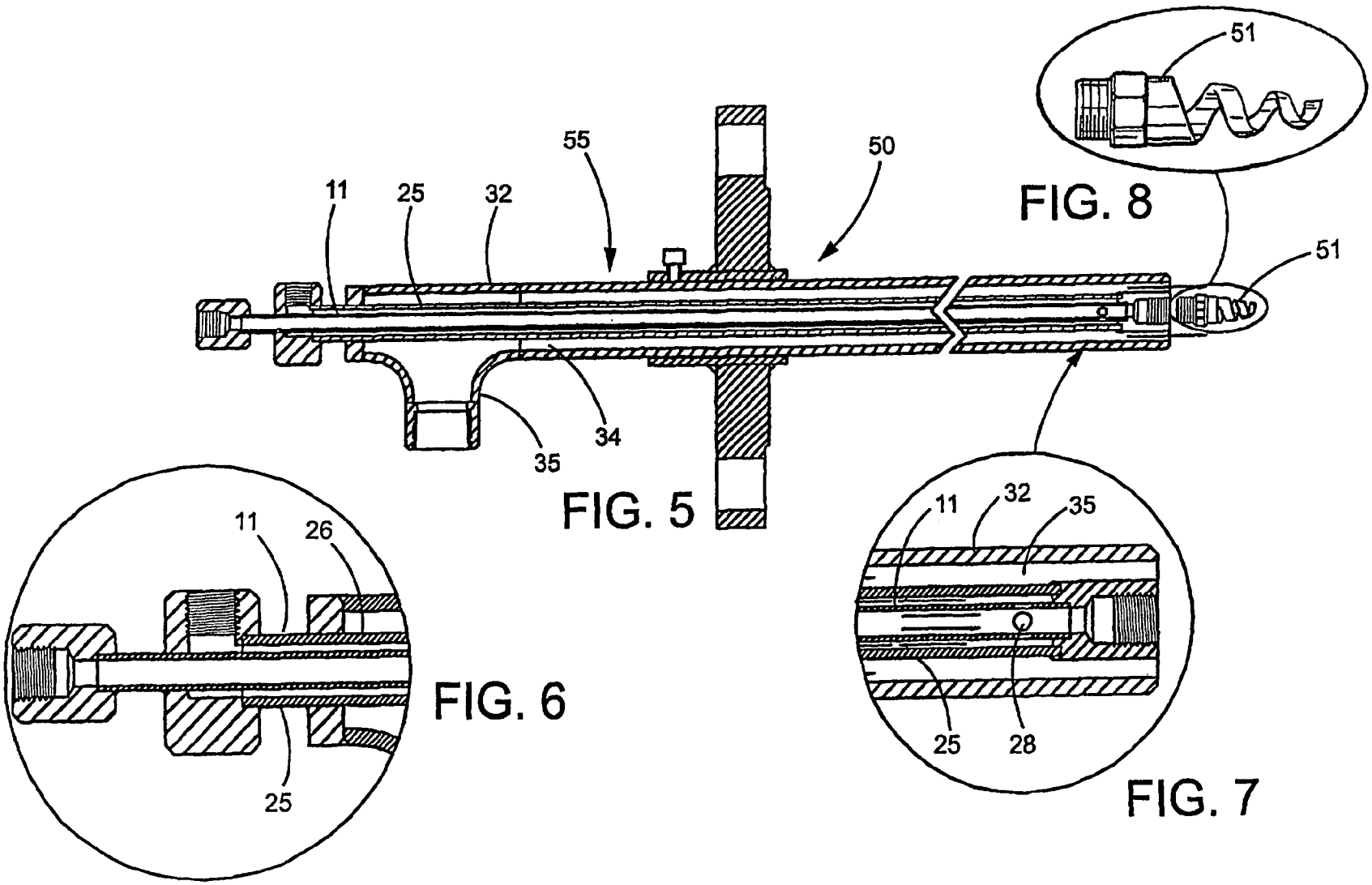
FIG. 5 is a longitudinal section of an alternative embodiment of urea-direction device in accordance with the invention.
FIGS. 6 and 7 are enlarged fragmentary sections of the lance shown in FIG. 4.
FIG. 8 is an enlarged side view of the illustrated spray nozzle of the device shown in FIG. 5.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF PREFERRED EMBODIMENTS

Referring now more particularly to FIGS. 1–3 of the drawings, there is shown an illustrative lance-type spraying device 10 for directing liquid reducing agents, such as urea, into a combustion zone or discharging combustion gases for controlling NOx emissions. The spraying device 10 includes a lance body 55 that has an elongated urea feed tube 11 having an inlet fitting 12 at an upstream end for connection to a urea supply and a downstream end connected to a nozzle holder 14 which supports a nozzle 15. The nozzle 15 in this case is an air atomizing spray nozzle assembly which utilizes pressurized air to break down and direct a liquid flow stream as an incident to spraying. The nozzle assembly may be of a known type for directing the desired discharging spray pattern, such as the air assisted spray nozzle assemblies offered by Spraying Systems Co. Preferably, the spray nozzle assembly may be of a type disclosed in provisional patent application Ser. No. 60/378,337 filed May 7, 2002, assigned to the same assignee as the present application, the disclosure of which is incorporated herein by reference. Such nozzle assembly, as depicted in FIG. 4, includes a nozzle body 16 threaded into a central passageway in the nozzle holder 14 and which defines a liquid passage 18, and an air cap 19 secured to the nozzle body 16 by a retaining ring 20 into which atomizing pressurized air streams are directed through air passages 21 in the nozzle body, as will become apparent.

Urea directed into the inlet fitting 12 is communicated through the feed tube 11 into and through the nozzle 15. As indicated previously, urea is highly temperature sensitive and will crystallize and clog the spray apparatus at temperatures far below those occurring in the environment of combustion processes with which NOx emission control equipment commonly is used.

In accordance with the invention, the lance-type spraying device is designed to maintain a liquid reducing agent, i.e., in this case urea, at temperatures for optimized atomization and direction, without premature crystallization. To this end, only a portion of the urea supplied to the nozzle is discharged with the remainder of the urea being recirculated to be urea supply along a passageway encompassing the feed tube. In the illustrated embodiment, the urea supply tube 11 is disposed within a urea return tube 25 which together define an annular urea return passage 26 for excess urea directed to the nozzle 14. The urea return tube 25 in this case is fixed in sealed relation at its downstream end to the nozzle holder 14 and has one or more radial passages 28 adjacent its downstream end which communicate with the return passage 26.

It will be seen that urea directed through the feed tube 11 in part will be directed into and discharge from the spray nozzle 14, and in part, by reason of the liquid back pressure, will be directed through the radial passages 28 and into the return passage 26. Urea entering the return passage 26 is forced through the return tube 25 to a urea return fitting 29 adjacent an upstream side of the urea feed inlet 12. The urea feed tube 11 in this case extends in sealed relation through the fitting 29. It will be appreciated that urea may be directed from the return fitting 29 to the liquid supply which may be maintained at a predetermined temperature for supplying urea to the feed tube 11. Hence, recirculation of a portion of the liquid reducing agent about and substantially along the length of the urea feed tube 11 itself provides a cooling medium to prevent overheating of the urea prior to atomization and discharge from the spray device.

In carrying out the invention, the lance-type spray device 10 is designed such that atomizing air directed to the spray nozzle 14 functions as a further cooling medium for the urea for maintaining the feed liquid within an acceptable temperature range for effective spraying. To this end, the spray device 10 includes an air atomizing air tube 32 mounted in concentric surrounding relation to the urea return tube 25 for defining an annular atomizing air passage 34 which extends along a substantial length of the urea return tube 25. The atomizing air tube 32 has a downstream end fixed in sealed relation adjacent the nozzle holder 14 and an upstream end which has an atomizing air inlet fitting 35. The atomizing air tube 32 in this case has an upstream end plate 36 through which the urea return tube 25 extends in sealed relation. Atomizing air directed to the inlet fitting 35 will pass through the atomizing air passage 34 through passages in or adjacent the nozzle holder 14, and communicate with the air passages 21 in the nozzle 15 for intermixing with, atomizing and assisting in direction of the desired discharging liquid spray. It can be seen that the atomizing air itself becomes an additional cooling medium for insulating the liquid urea directed through the spray device from the high temperatures associated with the combustion process.

In further carrying out the invention, the illustrated spray device 10 has an external cooling jacket 40 which includes an elongated liquid cooling jacket tube 41 disposed in concentric relation about a substantial length of the atomizing air tube 32 for defining an elongated liquid cooling chamber 42 about a substantial length of the atomizing air tube 32. The liquid cooling chamber 42 has end plates 44, 45 with a cooling liquid inlet fitting 46 which in this case has a tubular extension 48 for emitting cooling liquid at a location intermediate the ends of the cooling chamber 42. The cooling liquid flows in surrounding relation about the length of the atomizing air tube and is returned in circulating fashion to the cooling liquid supply through a return fitting 49, which in this case is located in the same end plate 44 as the inlet fitting 42.

From the foregoing, it will be seen that during operation of the lance-type spray device, simultaneous with the feed of the liquid reducing agent, namely liquid urea, through the feed tube 11, recirculating travel of the liquid urea through the urea return tube 25, combined with the flow of atomizing air and a cooling liquid through the concentrically mounted atomizing air tube 32 and liquid cooling jacket tube 41 effectively insulate the feed liquid from high temperatures associated with the combustion process for preventing crystallization of the urea prior to atomization and direction from the spray device.

It will be understood by one skilled in the art that advantages of the present invention may be obtained in various alternative embodiments of spray devices, as described below, where items similar to those described above have been given similar reference numerals. With reference to FIGS. 5–8, there is shown an hydraulic spray device 50 in which liquid, i.e. urea, is directed through a hydraulic spray nozzle 51, with excess feed liquid being recirculated through the urea return passage 26. For further cooling and insulating the feed liquid, cooling air in this instance is directed through a cooling air tube 32 supported in concentric surrounding relation to the urea return tube 25. The cooling air passes from an inlet fitting 35 adjacent an upstream end of the spray device 50 through the air passage 34 and discharges in axial surrounding relation to the liquid discharging spray. The illustrated liquid spray nozzle 51 is of a known spiral type, such as commercially available from Spraying Systems Co. under the trade name "SPIRAL JET."

Figures 9, 10, 11:
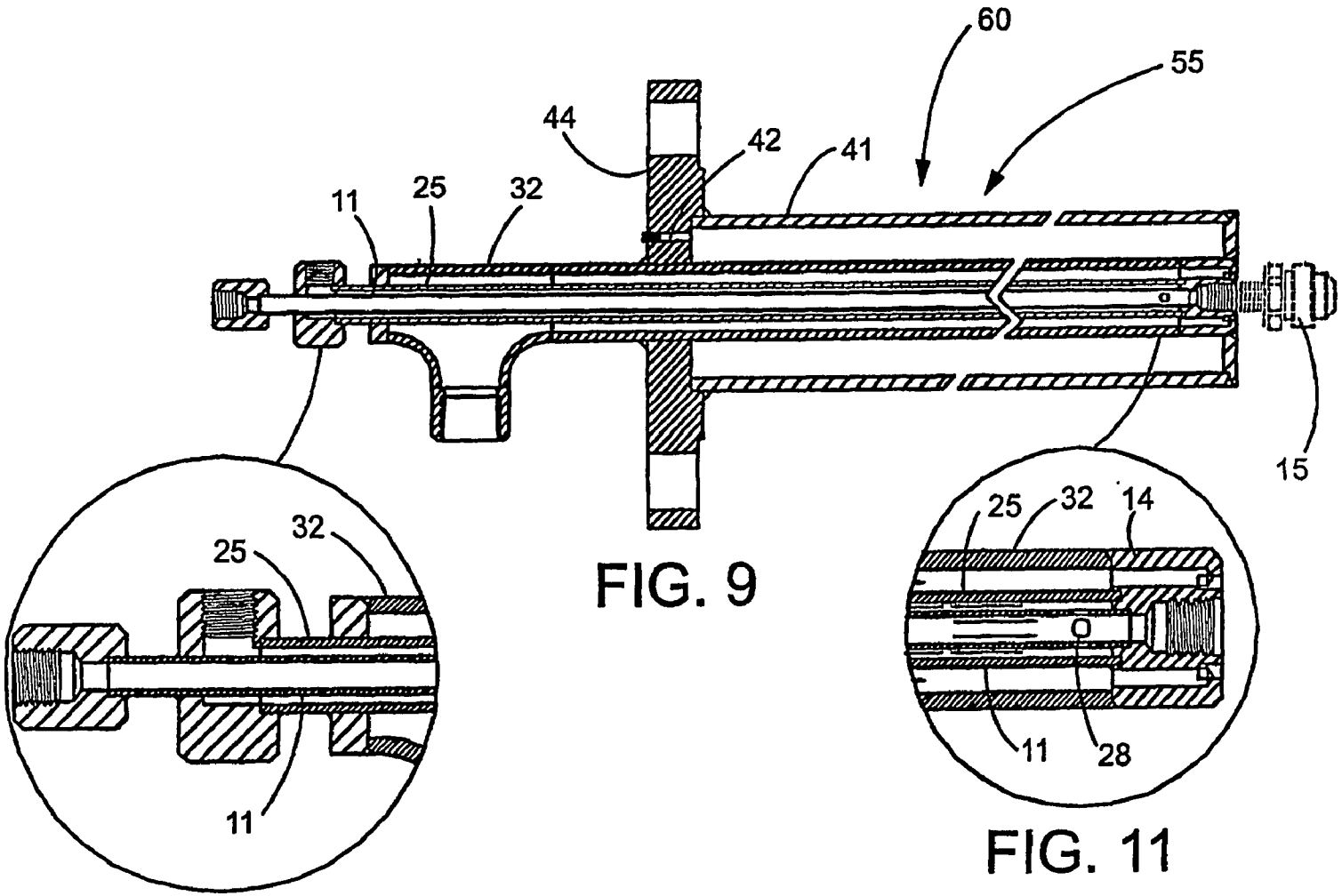
FIG. 9 is a longitudinal section of still another alternative embodiment of urea-directing lance in accordance with the invention.
FIGS. 10 and 11 are enlarged fragmentary sections of the lance shown in FIG. 7.

Referring now to FIGS. 9–11, there is shown another alternative embodiment of spray device 60 in accordance with the invention, which is similar to the embodiment of FIGS. 1–4 except that it includes a vacuum insulator jacket 41 in lieu of a liquid cooling jacket. A vacuum, drawn through a fitting 46 in an end wall 44, in this case creates the outer vacuum insulating layer about the atomizing air tube 32, urea return tube 25, and urea feed tube 11.

Figures 12, 13, 14:
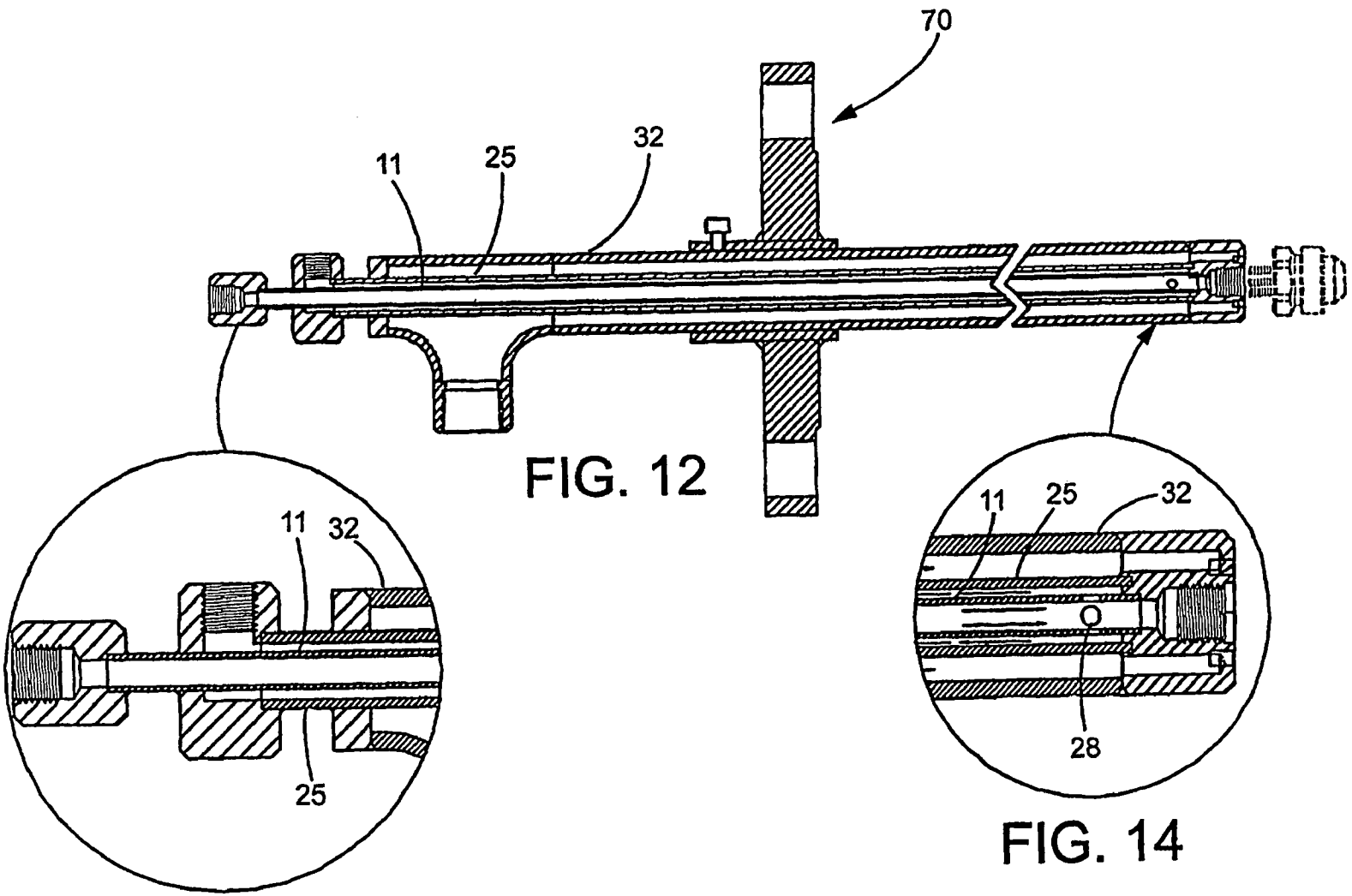
FIG. 12 is a longitudinal section of another alternative embodiment of lance in accordance with the invention.
FIGS. 13 and 14 are enlarged fragmentary sections of the lance shown in FIG. 10.

With reference to FIGS. 12–14, there is shown an air atomizing spray device 70, similar to FIG. 1, without the liquid cooling jacket. In this case, cooling and heat insulation of the feed liquid is achieved solely by the recirculating liquid urea and by the atomizing air flow.

Figures 15, 16, 17:
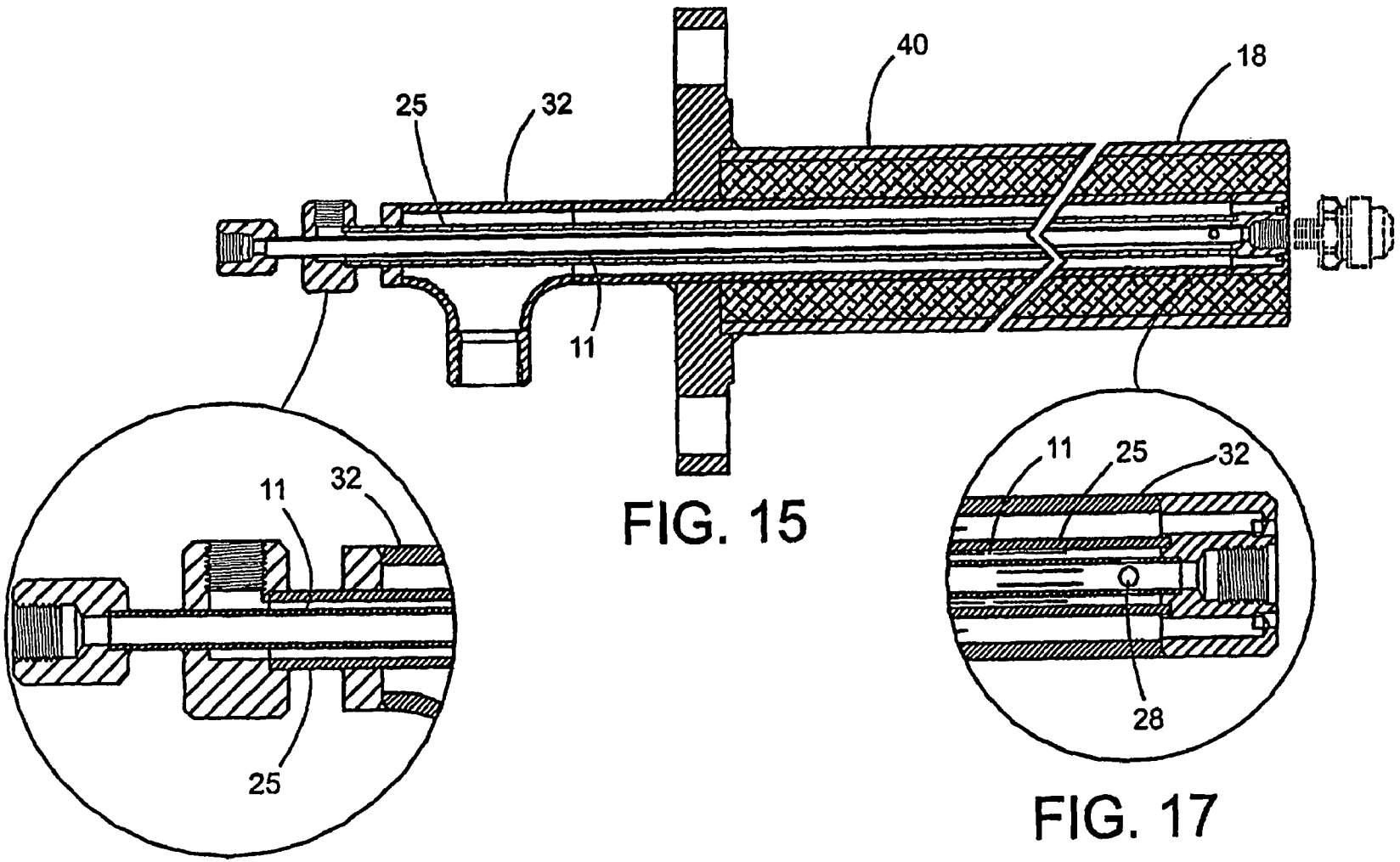
FIG. 15 is a longitudinal section of still another alternative embodiment of lance in accordance with the invention.
FIGS. 16 and 17 are enlarged fragmentary sections of the lance shown in FIG. 13.

With reference to FIGS. 15–17, a further alternative embodiment of spray device 80 is provided, which is similar to FIG. 1 but uses an insulation jacket 40, in lieu of a liquid cooling jacket. In lieu of a cooling liquid, a solid insulating material 81 is provided within the jacket 40.

Figure 18:
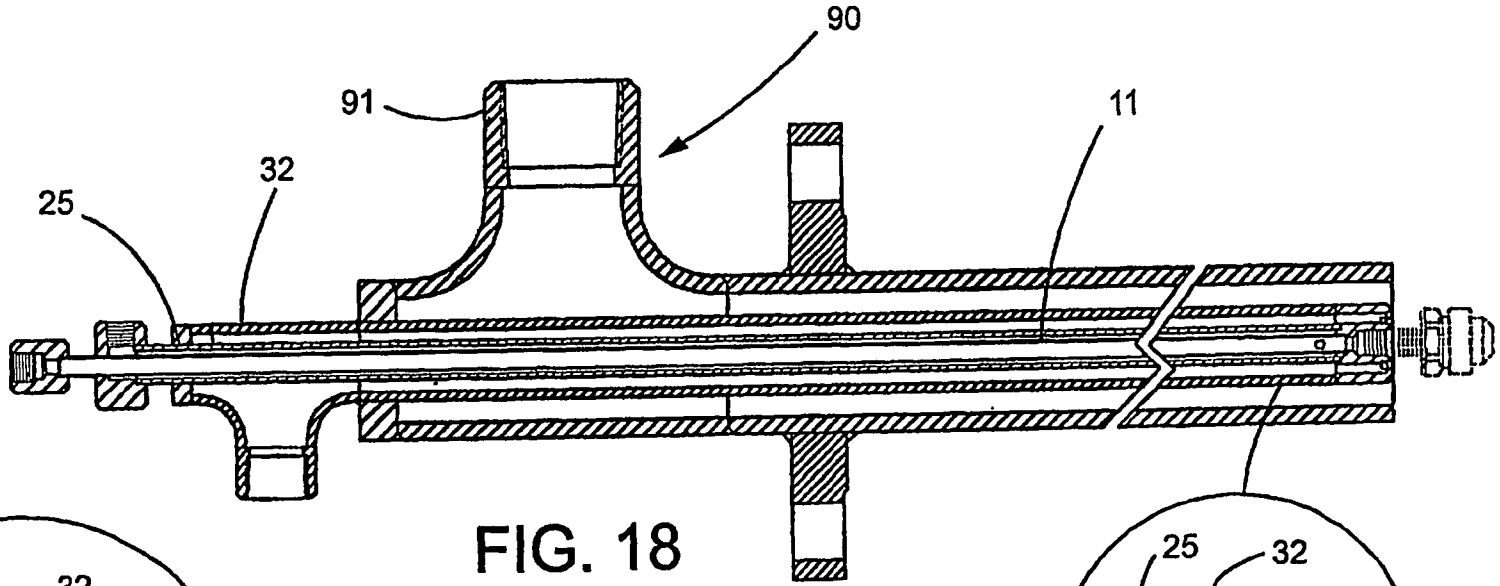
FIG. 18 is a longitudinal section of another alternative embodiment of lance in accordance with the invention.
Figure 20:
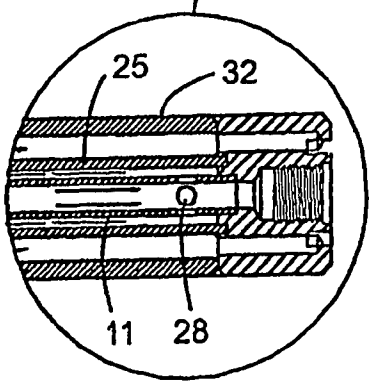
FIGS. 19 and 20 are enlarged fragmentary section of the lance shown in FIG. 16
Figure 19:
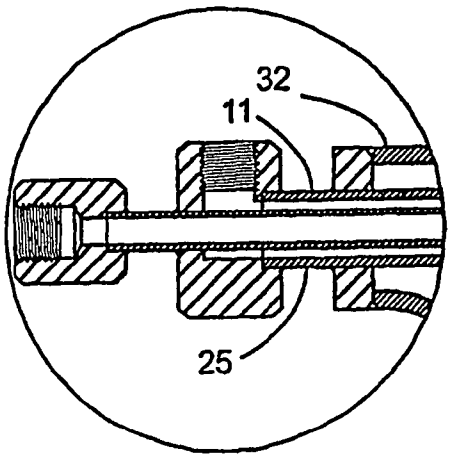

Finally, with reference to FIGS. 18–20, still another alternative embodiment of lance-type spray device 90 is shown, which is similar to FIG. 1 but which includes an outer air cooling jacket 40, in lieu of a liquid cooling jacket. In this case, cooling air is introduced through an inlet fitting 91 adjacent an upstream end of the air cooling jacket 40 for flow about and along substantial length of the atomizing air tube 32 for axial discharge in surrounding relation to the atomizing air nozzle assembly 14 and the discharging atomized spray.

What is claimed is:

1. A lance-type spraying assembly for directing a liquid reducing agent comprising:

a lance body having an inlet end and a downstream end; and a spray nozzle arranged at the downstream end of the lance body;

wherein the lance body includes an air passage for connection to an air supply, a liquid reducing agent supply passage for connection to a liquid reducing agent supply and a liquid reducing agent return passage, the liquid reducing agent supply passage communicating with the spray nozzle, the liquid reducing agent return passage communicating with the liquid reducing agent supply passage near the downstream end of the lance body for recirculating a portion of the liquid reducing agent and extending near the liquid reducing agent supply passage along at least a portion of the length thereof in order to help cool the liquid reducing agent therein, the liquid reducing agent return passage being sealed against the spray nozzle, and the air passage extending near at least a portion of the liquid reducing agent supply passage in order to help cool the liquid reducing agent therein.

2. The spraying assembly of claim 1 further including an external cooling jacket surrounding the lance body.

3. The spraying assembly of claim 2 wherein the external cooling jacket comprises a liquid cooling jacket.

4. The spraying assembly of claim 2 wherein the external cooling jacket comprises a vacuum insulator jacket.

5. The spraying assembly of claim 2 wherein the external cooling jacket comprises an insulation jacket.

6. The spraying assembly of claim 2 wherein the external cooling jacket comprises an air cooling jacket.

7. The spraying assembly of claim 1 wherein the liquid reducing agent return passage extends in surrounding relation to the liquid reducing agent supply passage.

8. The spraying assembly of claim 7 wherein the air passage extends in surrounding relation to the liquid reducing agent return passage.

9. The spraying assembly of claim 1 wherein the spray nozzle is an air atomizing spray nozzle and the air passage communicates with the spray nozzle.

10. The spraying assembly of claim 1 wherein air passage includes a discharge end near the downstream end of the lance body for discharging air in surrounding relation to the spray nozzle.

* * * * *